United States Patent [19]

Braasch

[11] Patent Number: 4,571,893

[45] Date of Patent: Feb. 25, 1986

[54] ROTARY GRINDING TOOL

[76] Inventor: Gerd Braasch, Sassenberg 31, 4475 Sogel, Fed. Rep. of Germany

[21] Appl. No.: 593,421

[22] Filed: Mar. 23, 1984

[30] Foreign Application Priority Data

Mar. 23, 1983 [DE] Fed. Rep. of Germany ..... 3310514

[51] Int. Cl.[4] ..... B24D 11/00

[52] U.S. Cl. ..... 51/397; 51/136; 51/402

[58] Field of Search ..... 51/135.1 R, 206 R, 328, 51/363, 394, 395, 397, 398, 401, 402, 405, 407, 136

[56] References Cited

U.S. PATENT DOCUMENTS

| | | | |
|---|---|---|---|
| 925,942 | 6/1909 | Oehm | 51/136 |
| 1,570,177 | 1/1926 | Pointer | 51/363 |
| 2,001,911 | 5/1935 | Wooddell et al. | 51/397 |
| 2,137,305 | 11/1938 | Perazzoli | 51/397 X |
| 2,214,515 | 9/1940 | Vanderveer | 51/391 |
| 2,770,928 | 11/1956 | Van Ormer et al. | 51/397 |

FOREIGN PATENT DOCUMENTS

| | | | |
|---|---|---|---|
| 516517 | 7/1977 | U.S.S.R. | 51/394 |
| 704740 | 12/1979 | U.S.S.R. | 51/135 R |

*Primary Examiner*—Robert P. Olszewski

*Attorney, Agent, or Firm*—Collard, Roe & Galgano

[57] ABSTRACT

This present invention relates to a rotary grinding tool, particularly to an endless grinding belt for a belt grinder machine, preferably used to grind wood profiles, in which a layer of elastic material is arranged on the working side of a rotary carrier element for abrasive, the thickness of which is a multiple of the thickness of the carrier element. The layer has on that surface which faces away from the carrier element a suitably prepared contour and can be coated with abrasive. The layer is divided into sections, each section consisting of a rubber block. The contour of the profile that is to be ground is reproduced in the blocks.

6 Claims, 9 Drawing Figures

ROTARY GRINDING TOOL

BACKGROUND OF THE INVENTION

1. Field of the Invention

This invention relates to a rotary grinding tool, particularly to an endless grinding belt for a belt grinding machine, used preferably for grinding molded wood products.

2. Description of the Prior Art

Wood products, for example, furniture rails and other contoured furniture components, are ground with grinding machines. The grinding machines have rotary grinding tools or else are configured as oscillating grinders. Grinding machines that have rotary grinding tools work either with rotating grinding disks or with rotary endless grinding belts.

The rotating grinding disks that are used for grinding wood profiles consist of a disk body, that have the contour of the profile that is to be ground molded into their circumference. An abrasive, for example, emery cloth, is attached to the circumference surface that is contoured in this manner. The useful life of the abrasive is dependent on the circumferential length of the grinding disk. The greater the grinding circumference, the higher the useful life that can be achieved. However, there are limits to both the disk circumference and thus the useful life, since at the motor speeds that are usually used and the larger diameter grinding disks cutting speeds become too high. Smaller grinding disk diameters such as are necessary for grinding relatively small radii on the wood profiles result, in the other hand, in very short useful lives. Grinding with grinding disks also entails the disadvantage that it is not possible to achieve satisfactory quality in the grinding as a result of the relatively small contact surface of the grinding disk on the wood profile that is to be ground.

Contrary to this, in belt grinding machines that operate with an endless rotary grinding belt it is possible to achieve a longer useful life of the grinding belt. In contrast to that achieved with grinding disks, the quality of the grinding is improved and the wood profiles that are to be ground can pass through the belt grinding machines at relatively higher feed rates. Normally, belt grinding machines are provided with continuous work-piece feed mechanisms for this reason. Belt grinding machines used to grind profiled and straight work-pieces have a replaceable pressure foot that bears the outline of the profile that is to be ground and this is usually arranged between two guide rollers for the grinding belt at approximately equal height. As the profile that is to be ground is fed through the machine this pressure foot presses the rotary grinding belt into the contoured pressure foot. In order to limit the application pressure for the grinding process the contoured pressure foot my also have an automatic springing system. The endless grinding belt consists of a flexible fabric that is coated with abrasive, said grinding belt being relatively stiff for production reasons and also because it must be tightened and guided through the grinding machine.

In order that curved work-pieces can also be ground in a belt grinding machine, in place of the pressure foot a replaceable guide roller is configured as a pressure roller and provided on the circumference with the contour of the profile that is to be ground. The work-piece that is to be ground, as is the case when a pressure foot is used, must press the tightened and thus extremely stiff grinding belt into the contours of the guide and pressure roller, and this is only possible in the case of contoured shapes having larger radii and smaller contour depths.

For this reason, a belt grinding machine cannot grind contoured shapes that are both convex as well as concave in one and the same work step. Because of feed problems and the stiffness of the conventional grinding belts a grinding machine can only grind parts or sectors, respectively, of the profile contour when complicated profile forms are involved. For this reason it is usual to use very long grinding machines that incorporate a plurality of several grinding sets arranged in sequence, these being tiltable up to 135° in order to be able to grind the whole profile contour is one pass. These multi-grinding machines incur very high levels of investment and need very long set-up times.

A further disadvantage can be seen in the fact that the contoured pressure foot soon loses its profile contour as a result of friction on the back of the rotary grinding belt and for this reason has to be replaced or renewed, respectively, very frequently. Pressure feet that do not have a costly mechanical springing system can also burn the grinding belt.

Since the contoured work-piece that is to be ground must press the rotary grinding belt into the pressure foot the innermost contours of the profile are very hard for the grinding belt to reach whereas the external rounded portions of the profile contour are ground to an increased degree. This is particularly disadvantageous in the case of profile shapes that are covered with a very thin veneer. The constant deformation of the grinding belt when it is pressed into the profile contour of the pressure foot exposes it to a great deal of punishment and this can lead to separation of the abrasive grain which in turn leads to a reduction in the useful life of the grinding belt.

In contrast to the belt grinding machines that operate with a pressure foot in which a large contact surface on the profile that is to be ground is provided by the relatively long pressure foot, with the advantage that the quality of the grinding work that can be achieved is improved, a belt grinding disk with a contoured guide and pressure roller offers a greatly reduced contact surface which corresponds approximately to the contact surface provided by a grinding disk. The contoured guide rollers are for this reason kept at the greatest possible diameter since, if smaller diameters are used limits are imposed on the three dimensional deformation of the grinding belt that passes over the guide roller. Thus it is common to the use of all belt grinding machines with both contoured guide rollers and with contoured pressure feet that it is impossible to grind smaller radii. Only larger and simple radii of a wood profile can be ground.

In addition, belt grinding machines entail the disadvantage that the grinding belt cannot be guided with sufficient accuracy when used for one sided profile contours.

Grinding wood profiles with rotating grinding disks, as opposed to belt grinding machines, does however entail the advantage that small radii can be ground to a relatively true profile. As opposed to this the useful life of the grinding disk is shorter than the useful life of the belt grinding machines and the grinding quality that can be achieved with grinding disks is poorer than the quality that can be achieved using belt grinding machines that work with contoured pressure feet.

SUMMARY OF THE INVENTION

It is the aim of the present invention to create a rotary grinding tool, in particular for a belt grinding machine, which, whilst avoiding the disadvantages that are common to known grinding tools combines the advantages of a profiled grinding disk and a rotary grinding belt.

According to the present invention, this task is solved in that a layer of elastic material is arranged on the working side of a rotary carrier element for an abrasive, the thickness of said layer being a multiple of the thickness of the carrier element, and in that the layer is contoured on its surface that faces away from the carrier element so as to match the profile that is to be ground, and can be coated with an abrasive.

A complicated contour of the profile that is to be ground can be prepared quite easily in the relatively thick layer of elastic material. As a consequence of this it is also possible to grind contours having small radii. Compared to the grinding disk, with which small radii can also be ground, the grinding tool according to the present invention entails the advantage that in the same manner as using conventional belt grinding machines with grinding belts, it is possible to achieve longer useful lives and improved grinding quality.

The grinding tool according to the present invention can be used readily on existing belt grinding machines. A profiled pressure foot can be dispensed with. All that is needed is simply a straight pressure element, e.g., a simple metal plate, in order to keep the contoured, belt-like, continuously rotating grinding tool in contact with the work-piece that is to be ground. For grinding straight work-pieces, e.g., contoured rails, the pressure element can be of any length, so that the larger contact surface that results from this will result in a higher grinding quality.

A grinding agent, e.g., emery paper, is cemented securely to the contoured layer so that complicated contours can be ground in one process with a high level of contour accuracy, for a longer useful life and at a high degree of grinding quality. It becomes unnecessary to use a plurality of belt grinders, each of which grinds one part of a contour, and the longer set-up times that this necessitates can be eliminated.

In addition, the elastic spring characteristics of the material for the contoured layer also entail the advantage that it is possible to work with relatively high application pressures, without the abrasive that is cemented to the layer being burnt off.

The grinding tool that is created in accordance with the present invention thus entails the advantages of a rotary grinding disk with the advantages of conventional grinding belts without the need to accept any of the attendant disadvantages.

According to a development the grinding tool is characterized in that the layer is divided throughout the length of the carrier element into essentially evenly divided and separated sections.

This entails the advantage that, for example, when grinding curved or scalloped profiles it is also possible to achieve a sharp deflection over guide rollers of smaller diameter without the relatively thick layer being subjected to higher loads, e.g., by twisting or stretching during this deflection since the gaps between the individual sections can align themselves with the axis of deflection during this deflection process.

A softer, thinner, non-extensible and endless flat belt can be used as a carrier element for the layer, it being possible to install this under tension on the guide drive rollers of a conventional belt grinding machine. The guide rollers can have smooth surfaces. The width of the belt can be selected to any width that corresponds to the width of the profile that is to be ground. The back drive surface of the flat belt can be provided with a wear resistant and slippery coating, e.g., cloth, in order that only very slight frictional resistance results on the pressure plate that replaces the pressure foot of a conventional belt grinding machine.

The flat belt can be produced of any suitable material, for example, rubber, plastic, textiles, leather, or the like. Of course, it is also possible to use a chain-linked belt, a plate belt or the like. Thus, for example, the individual sections of the layer can also be articulated to each other by means of individual elements.

Each section can be formed by parallel cuts in the layer. It is preferred that each section be a block consisting of rubber. It is no problem to produce rubber at any desired degree of elasticity so that grinding tools according to the present invention can be produced with different degrees of elasticity depending on the purpose for which they are used and with regard to the desired grinding operations that are to be carried out.

Individual blocks can be secured in the simplest manner to the flat belts. In a preferred version each of the blocks is cemented to the working surface of the flat belts. The working surface of the flat belt can have a rubber coating which is roughened prior to cementing the individual blocks into place in order to achieve improved adhesion.

According to a further development the grinding tool is characterized in that each of the blocks has a foot area that can be secured to the flat belt, and a head block that is arranged above this, in which the contour shape is reproduced by removal of some of the material constituting the block. To this end, for example, a previously prepared wood profile can have a piece of emery paper, of, e.g. 100 grit, cemented to it. The flat belt, provided initially with unshaped blocks, is then driven and moved slowly by the belt grinding machine to the profile to which the emery paper has been cemented until the desired outline of the profile has been ground into the blocks of the grinding tool. The blocks produced in this manner can then have emery paper cemented to them at which point the grinding tool is ready for operation in order to grind the most complicated profiles accurately and at high quality in one work stage.

The division of each of the blocks into a foot area that can be attached to the flat belt and the head block that reproduces the contour of the profile that is to be ground is an important characteristic from the point of view of the present invention; this is so since it results in the advantage that for the most part deformations of the block caused by twisting and stretching loads in the deflection area of the rotating grinding belt are restricted to the foot area alone. The head block is not deformed so that the contour shape in the head block is not deformed, particularly when working upon curved wood profiles in which grinding operations are carried out directly in the deflection area, this resulting in the fact that high quality grinding work can be carried out to very accurate contours.

This concept, important from the point of view of the present invention, also ensures that deformations of a block extend only into the foot area that is in contact with the flat belt, is further developed so that, in relation to the total height of the block that is established by the thickness of the layer, the height of the foot area is less than the height of the head block. Such a configuration makes it possible to form relatively deep contours in the head block. The restriction of block deformations to the foot area can be achieved, for example, in that the foot area is configured from softer and thus more elastic rubber, whereas the head block consists of relatively hard rubber that is difficult to deform. It presents no difficulties to produce components with areas having varying degrees of elasticity.

It is possible to create an area on each block which alone traps all the deformations that occur by special configuration of the foot area. Thus, for example, the foot area of the block can be set off from the head block by means of block recesses that are transverse to its rotary movement. The material cut out transversely from the foot area of each block will be reduced by such recesses and as a result of this such areas of lesser material thickness in the foot area will be easier to deform than the thicker areas of material of the head block that has the required contour.

In a preferred version, in each side wall of a block there is a recess in the form of a groove the side of which that faces the foot area of the block being inclined and extending to the outer lower edge of the foot area. In addition to the easier deformability of the foot area this particular configuration entails the advantage that adhesion is more permanent since the actual glued joint will be subjected to lesser loads because of the greater ability to twist in the foot area that is made thinner because of this slope.

In addition, the grinding tool is characterized in that the contact surface of the foot area of the block that can be joined to the flat belt has a recess. This recess too contributes to the fact that deformations of the block caused by deflection are restricted to the foot area alone. In a particularly advantageous version it is foreseen that the recess is of an arc-shaped cross section in which connection the radius of the arc is approximately equal to the radius of a guide pressure roller associated with the carrier strip in the work area. Thus it is possible to work with guide rollers or pressure rollers, respectively that are of relatively small diameter. Of course, the recesses can be shaped otherwise. Thus, for example, it is also possible to provide a wedge-shaped recess.

The soft elasticity that results from the special configuration of the foot area also entails the advantage that it prevents any burning of the abrasive during the grinding process.

DESCRIPTION OF THE DRAWINGS

Exemplary versions of the invention, which reveal further innovative features, are shown in the drawings appended hereto. These drawings are as follows.

DESCRIPTION OF THE PREFERRED EMBODIMENT

Figure 1:
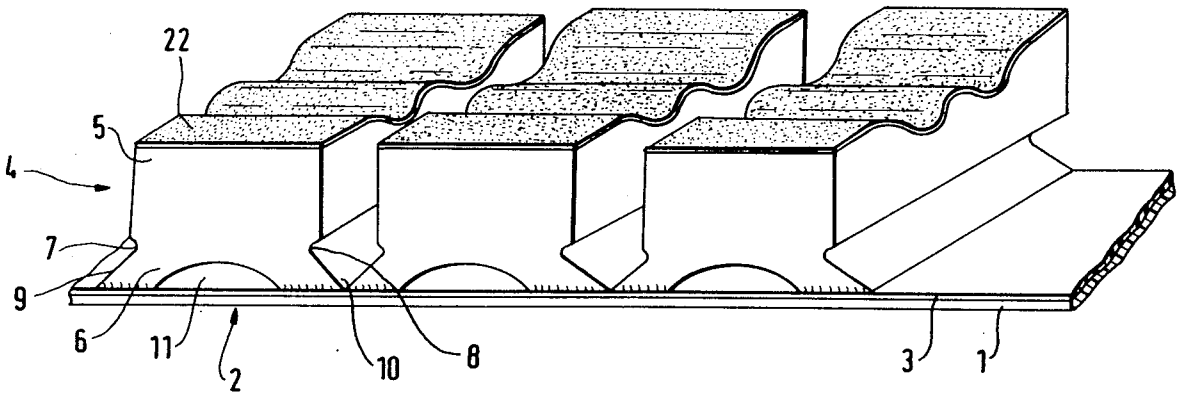
FIG. 1. a perspective view of a partial area of a rotary grinding tool with one version of the blocks.

FIG. 1 is a perspective view of a partial area of a grinding tool. The grinding tool consists of a soft, thin but non-extensible flat belt 1 which, at any length, is closed to form an endless loop. The upper side which is opposite the drive surface of the flat belt is coated with a layer of rubber 3. Blocks 4 of rubber are cemented in a continuous series onto this rubber layer, these being so configured as to have a pad-like head block 5 and a foot area 6. The foot area 6 is set off from the head block by means of grooves 7 and 8 in each side of every block. The sides 9 and 10 of each block which face the foot area are, as shown, inclined and extend to the outer lower edge of the foot area. The contact surface of the block that can be joined to the flat belt 1 has a recess 11 which, in this case, is of an arc-shaped cross section.

Because of this special configuration of the foot area the contact area of the block that can be attached to the flat belt is relatively small, so that any twisting deformations that result in the area of a guide or pressure roller when the flat belt is deflected will be restricted to the foot area alone.

In the upper working side of each head block 5 of a block 4 it is possible to grind in or cut in the contour that is to be ground, as is shown in FIG. 1. The prepared contour has a grinding means, here, for example, emery paper 22, cemented to it, the grinding tool then being ready for operation once it has been installed on the guide and drive rollers of a belt grinder machine.

Figure 2:
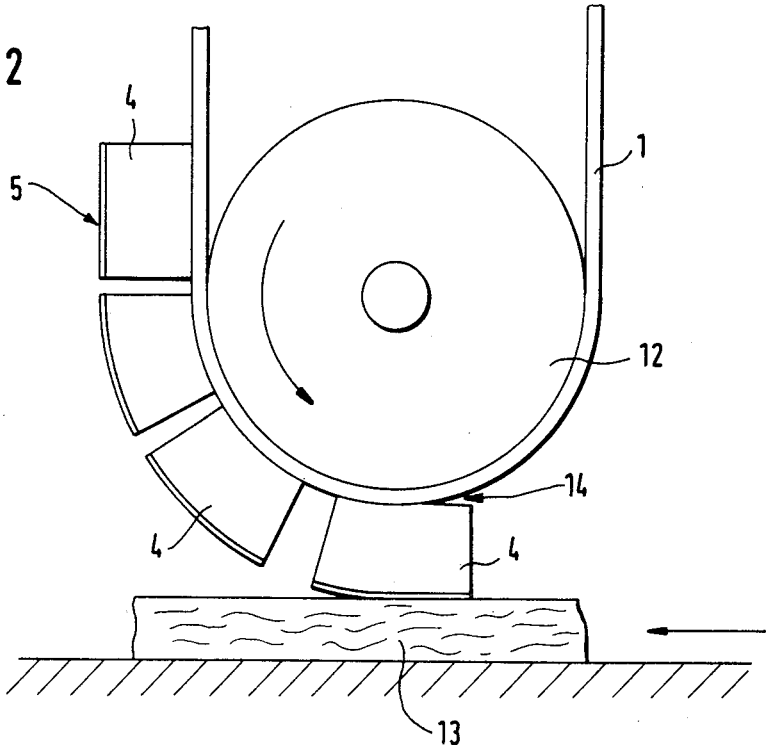
FIG. 2. a schematic side view of a guide and pressure roller in the working area of a belt grinding machine having a rotary flat belt upon which there are simple pad-shaped blocks.

FIG. 2 is a schematic illustration of a deflection and pressure area in a belt grinder machine. The flat belt 1 passes over the guide and pressure roller 12. The flat belt is fitted with blocks which do not have the special configuration shown in FIG. 1. As a result of this, any contour that is reproduced in the head block 5 of a block 4 will be very greatly deformed so that a work-piece 13 that is to be ground and which is passed through the machine in the direction of the arrow towards the left will not be ground with the required accuracy. Furthermore, the glued joint in the area of contact between the flat belt 12 and the block 4 can be loosened as the result of stretching as is indicated by the arrow 14.

Figure 3:
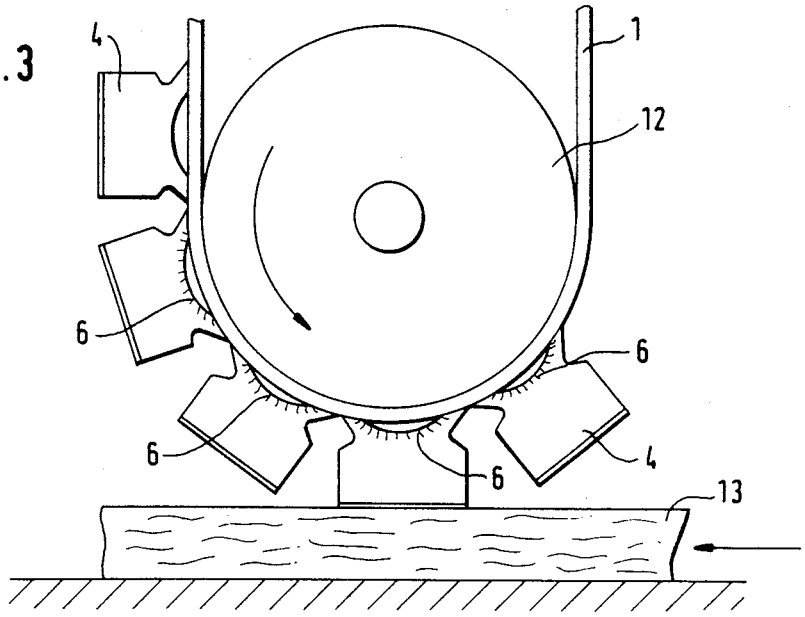
FIG. 3. a view of a belt grinding machine according to FIG. 2, this having a grinding tool that incorporates blocks configured in accordance with the present invention.

FIG. 3 shows the same work area of a belt grinding machine as is shown in FIG. 2. Identical components bear the same reference numbers. In contrast to the grinding tool shown in FIG. 2, the blocks in this case are of the configuration according to the present invention in the foot area so that any twisting and stretching deformations of the blocks that result from the deflection of the flat belt 1 that is fitted with blocks 4 on the guide and pressure roller 12 will be restricted to the foot area that is shown shaded in this illustration. This means that the work-piece 13 can be ground to a very accurate profile at very high grinding quality.

Figure 4:
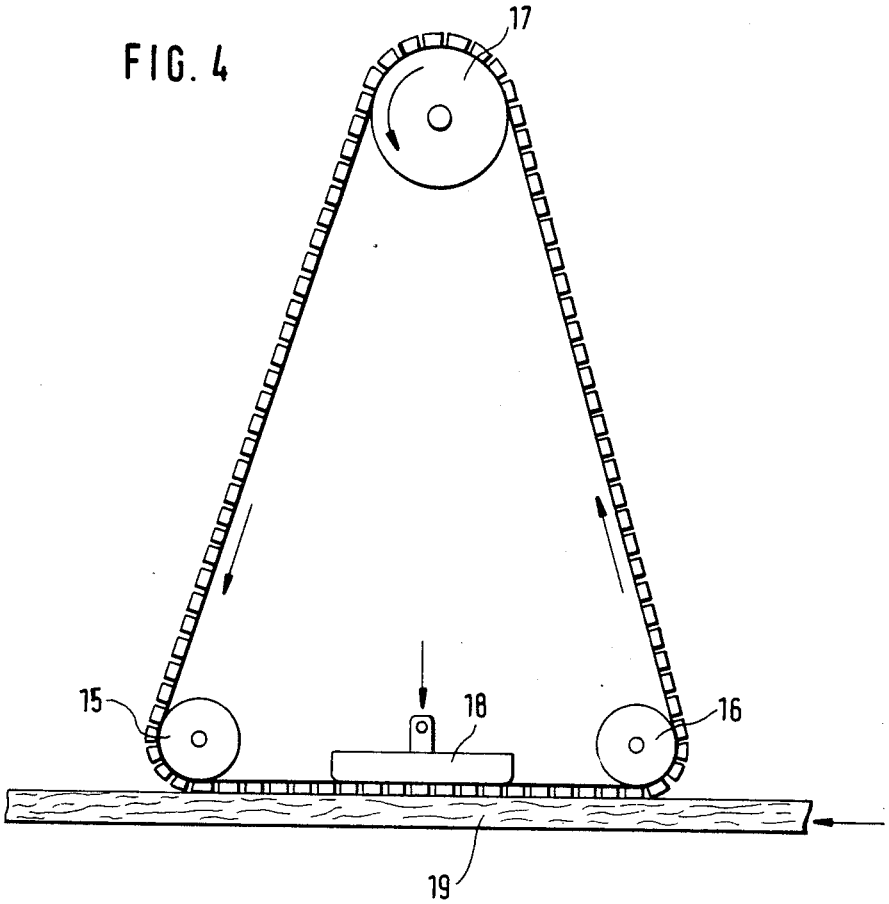
FIG. 4. a schematic side view of the working area of a belt grinding machine with a grinding tool according to the present invention used to grind straight profile strips.

FIG. 4 is a schematic illustration of a belt grinding machine in side view. The belt grinding machine consists of two deflection rollers 15 and 16 as well as an upper deflection and drive roller 17. The carrier belt fitted, as described above, with blocks passes in a triangular path about the rollers 15, 16 and 17 and is kept taut by the rollers. The reference numeral 18 indicates a pressure element configured in the form of a simple plate that absorbs the pressure of a straight contoured strip 19 that is to be ground.

Figure 5:
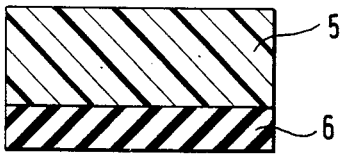
FIGS. 5 to 7. various versions of a single block in cross section.

FIG. 5 shows a version of a block in cross section in which the head block consists of hard relatively inelastic rubber, as opposed to the foot area 6 which is joined to it and consists of soft rubber. Using such a configuration of a block made up of areas of different elasticity it is possible to dispense with any special configuration of the foot area.

Figure 6:
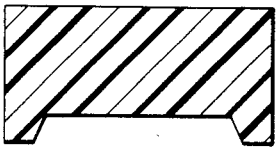
Figure 7:
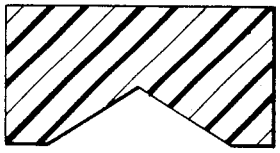

FIG. 6 illustrates another version for the configuration of a foot area. The recess used to provide a match with short radii of a deflection and pressure roller is here configured as a relatively wide right-angle groove. FIG. 7 shows a recess of the same sort, configured not as an arc, but as a flat angled notch.

Figure 8:
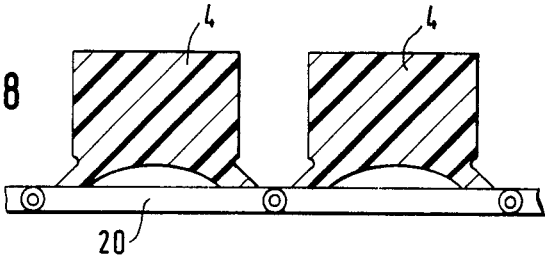
FIG. 8. a side view of a version of the grinding tool with a plate-belt fitted with blocks configured according to the present invention.

FIG. 8 illustrates a portion of a grinding tool in which the endless rotary flat belt is replaced by plates 20 that are articulated to each other. A block 4 is mounted on each such plate.

Figure 9:
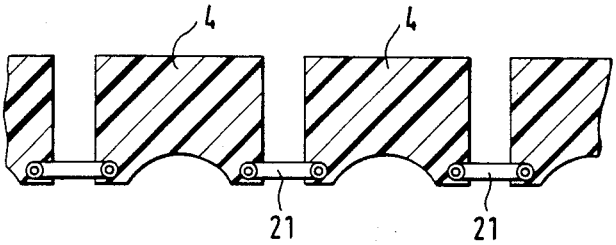
FIG. 9. a side view of a version of the grinding tool configured as a linked belt.

FIG. 9 is a schematic side elevation of a portion of a rotary grinding tool in which the carrier element has been completely replaced in that the individual blocks 4 are connected to each other by links 21.

What is claimed is:

1. A rotary grinding tool, particularly an endless grinding belt for a belt grinder machine for grinding wood profiles, said grinding tool comprising:

a rotary carrier element in the form of a soft, thin, non-extensible flat belt having a working side thereon; and a layer formed of rubber on said working side of said flat belt, the thickness of said layer being a multiple of the thickness of said carrier element, said layer having a contour on the side facing away from said carrier element corresponding to the profile to be ground and which is coated with abrasive, said layer of rubber being divided into sections in the form of separated blocks evenly disposed along the length of said flat belt, each block comprising an elastic and deformable foot area cemented to the working side of said flat belt and a hard head block arranged thereabove having said contour therein.

2. A grinding tool according to claim 1, wherein in relation to a total height of the blocks which is determined by the thickness of the layer, the height of the foot area is less than the height of the head block.

3. A grinding tool according to claim 2, wherein the foot area of the block is set off from the head block by means of recesses in the block which are transverse to the rotary path of movement of the rotary grinding tool.

4. A grinding tool according to claim 3, wherein each recess is formed as a groove in a side of the block, the side of which facing the foot area being sloped and extending as far as the outer lower edge of the foot area.

5. A grinding tool according to claim 2, wherein the contact area of the foot area of the block that is joined to the flat belt is provided with a recess.

6. A grinding tool according to claim 5 utilized with a guide and pressure roller having a radius, wherein the recess is of arc-shaped cross section, the radius of the arc being approximately equal to the radius of the guide and pressure roller.

* * * * *